US006077149A

United States Patent [19]

Ohkuni et al.

[11] Patent Number: 6,077,149

[45] Date of Patent: Jun. 20, 2000

[54] METHOD AND APPARATUS FOR SURFACE-GRINDING OF WORKPIECE

[75] Inventors: Sadayuki Ohkuni; Tadahiro Kato; Hideo Kudo, all of Fukushima-ken, Japan

[73] Assignee: Shin-etsu Handotai Co., Ltd., Tokyo, Japan

[21] Appl. No.: 08/953,515

[22] Filed: Oct. 17, 1997

Related U.S. Application Data

[63] Continuation of application No. 08/520,186, Aug. 28, 1995, abandoned.

[30] Foreign Application Priority Data

Aug. 29, 1994 [JP] Japan ..... 6-227291

[51] Int. Cl.[7] ..... B24B 5/04

[52] U.S. Cl. ..... 451/41; 451/285; 451/286

[58] Field of Search ..... 451/41, 285, 286, 451/287, 288, 289, 388, 460

[56] References Cited

U.S. PATENT DOCUMENTS

| | | | |
|---|---|---|---|
| 3,872,626 | 3/1975 | White | 451/285 |
| 4,009,539 | 3/1977 | Day | 451/289 |
| 4,316,757 | 2/1982 | Walsh | 451/460 |
| 4,579,705 | 4/1986 | Matsuoka et al. | 451/41 |
| 4,597,228 | 7/1986 | Koyama et al. | 451/289 |
| 4,693,036 | 9/1987 | Mori | 451/287 |
| 4,852,631 | 8/1989 | Herbin et al. . | |
| 5,004,512 | 4/1991 | Fodera | 451/41 |
| 5,035,087 | 7/1991 | Nishiguchi et al. | 451/285 |
| 5,256,599 | 10/1993 | Asetta et al. | 451/460 |
| 5,297,365 | 3/1994 | Nishioka et al. | 451/41 |
| 5,542,874 | 8/1996 | Chikaki | 451/289 |

FOREIGN PATENT DOCUMENTS

| | | |
|---|---|---|
| 0 286 481 | 3/1988 | European Pat. Off. . |
| 0 588 055 A2 | 8/1993 | European Pat. Off. . |
| 3 627113 | 1/1989 | France . |
| 2216441 | 10/1989 | United Kingdom . |

*Primary Examiner*—Eileen P. Morgan
*Attorney, Agent, or Firm*—Barnes & Thornburg

[57] ABSTRACT

In a surface-grinding method for a workpiece, for example a semiconductor wafer, it is possible to correct or improve waviness and bow and to obtain a semiconductor wafer having no thickness dispersion. Besides, wafer processing to higher precision than that conventionally attained is achieved and at the same time simplification of the processing method and thereby reduction of the cost are also achieved. In the present invention, while the workpiece is fixed for supporting at one surface by the fixedly supporting means of a surface-grinding apparatus, the other surface of the workpiece is surface-ground, where the workpiece adheres on the upper surface of a base plate by the aid of adhesive material and the base plate is fixedly supported by the lower surface of itself on the fixedly supporting means.

24 Claims, 10 Drawing Sheets

METHOD AND APPARATUS FOR SURFACE-GRINDING OF WORKPIECE

This is a Continuation of application Ser. No. 08/520,186, filed Aug. 28, 1995 now abandoned.

BACKGROUND OF THE INVENTION

1. Field of the Invention

The present invention relates to improvements in a method and apparatus for surface-grinding of a workpiece or workpieces, for example, ceramic wafers, quartz wafers, semiconductor wafers and the like (hereinafter also referred simply to as wafers).

2. Description of the Prior Art

A conventional processing method used for a workpiece or workpieces, for example wafers, comprises, as shown in FIG. 6:

- a slicing step A, in which a cylindrical semiconductor ingot or cylindrical semiconductor ingots are cut (or sliced) into wafers, each in the shape of a thin plate, by a wire saw, a circular inner peripheral blade or the like;
- a chamfering step B, in which the peripheral edge portions of each sliced wafer are removed in order to prevent chipping along the periphery;
- a lapping step C, in which both sides of each chamfered wafer are lapped for correcting the thickness and flatness;
- an etching step D, in which the whole surface of each lapped wafer is etched by dipping it into an etching solution in order to eliminate the work damage; and
- a polishing step E, in which each etched wafer is mirror-polished across one side or the two sides to improve the surface roughness and flatness.

The cross-sectional views of wafers processed in the conventional method shown in FIG. 6 are shown, in sequence of the processing steps, in FIG. 9(*a*) to FIG. 9(*d*).

In the figure,

- SW denotes a sliced wafer just after completion of the slicing step,
- LW denotes a lapped wafer just after completion of the lapping step,
- EW denotes an etched wafer just after completion of the etching step, and
- PW denotes a polished wafer just after completion of the polishing step.

The surface irregularity and curvatures of wafers in FIG. 9(*a*) through FIG. 9(*d*) are respectively the waviness and bows drawn in their stressed forms.

The wafer SW just after completion of the slicing step has a form including waviness and bow. This occurs by the reason that a cutting edge does not necessarily advance in a straight line due to delicate imbalance of cutting resistances on either side of the cutting edge.

The contour of a relatively large cycle like those of a bowl or an S character is called Bow and that of repeated irregularity with a small cycle on the order of several mm is called Waviness.

When a wire saw or a circular inner peripheral blade is used, waviness and bow occurs in both cases. But waviness is easier to occur and becomes a problem especially when a wire saw is used. A wafer just after slicing has a chance to have bow due to work damage. At this time it is necessary to slightly etch the wafer surface.

In the current general wafer processing method as shown in FIG. 6, the lapping step C has a function to improve waviness but it has been difficult to correct bow because of easy elastic deformation of a wafer (FIG. 9(*a*) to FIG. 9(*d*)).

As the integration levels of semiconductor devices have recently risen, the semiconductor wafers as substrates have had the demand for a higher flatness level.

In order to obtain a wafer or wafers each with a high precision form of this higher flatness level, it is necessary to put surface-grinding into the process.

When this surface-grinding is desired, the following methods may be used, which are:

- a processing method shown in FIG. 7 (a slicing step A—a surface-grinding step H—a chamfering step B—a polishing step E.) or
- another processing method shown in FIG. 8 (a slicing step A—a chamfering step B—a lapping step C—an etching step D—a surface-grinding step H—a chamfering step B2—a polishing step E).

Here the surface-grinding step H is the one in which a publicly known surface-grinding apparatus 20 as shown in FIG. 12 is used.

In FIG. 12, 22 denotes a grinding stone, 24 denotes a fixedly supporting means and W denotes a workpiece such as a wafer.

In the processing method shown in FIG. 7, the lapping step is omitted and the method is better in terms of processing due to the simplification in processing steps.

If surface-grinding is conducted, however, with a surface-grinding apparatus adopting a conventional way for fixedly supporting a wafer or wafers (for example, the way in which the wafer or wafers are vacuum-sucked onto a rigid chuck table like a porous ceramic plate or the like), there was a problem that waviness and bow of each wafer are almost never improved due to elastic deformation during suction.

A conventional surface-grinding technique applied to the processing method of FIG. 7 comprises, for example as shown in FIG. 10(*a*) to FIG. 10(*i*):

(a) a step, in which a wafer SW just after completion of a slicing step (FIG. 10(*a*)) is fixed by chucking to a vacuum-chuck means 12 by the lower surface (FIG. 10(*b*));

(b) a step, in which the upper surface of the fixed wafer SW is surface-ground (FIG. 10(*c*));

(c) a step, in which the wafer, the upper surface of which has been surface-ground, is released from the vacuum-chuck means 12 (the waviness and bow of a wafer HW1, the upper surface of which has been surface-ground, remains uncorrected as they were) (FIG. 10(*d*));

(d) a step, in which the wafer HW1, the upper surface of which has been surface-ground, is turned upside down (FIG. 10(*e*));

(e) a step, in which the turned wafer HW1 is fixed by chucking to the vacuum-chuck means 12 by the upper surface (FIG. 10(*f*));

(f) a step, in which the lower surface of the fixed wafer HW1 is surface-ground (FIG. 10(*g*));

(g) a step, in which the wafer HW2, both surfaces of which have been surface-ground, is released from the vacuum-chuck 12 (the waviness and bow of the wafer HW2, both surfaces of which have been surface-ground, remains uncorrected as they were.) (FIG. 10(*h*)).

In FIG. 10(*a*) to FIG. 10(*i*), HW1 denotes a wafer, one of the surfaces of which is surface-ground and HW2 denotes a wafer, both surfaces of which are surface-ground.

Thereafter, the wafer, both surfaces of which have been surface-ground, is polished, but the waviness and bow remain on this polished wafer PW, as shown in a view (FIG. 10(*i*)).

In this manner, if the conventional surface-grinding technique is simply introduced, waviness and bow of a wafer or each of wafers remain even after polishing and the quality of the wafer or wafers is greatly deteriorated.

Therefore, the method shown in FIG. 7 and FIG. 10(*a*) to FIG. 10(*i*) was not put to practical use.

A wafer processing method as shown in FIG. 8 has been proposed in addition to that of FIG. 7 and FIG. 10(*a*) to FIG. 10(*i*), as a processing method including a surface-grinding technique, as described above.

The processing method of FIG. 8 is a modification of the conventional method of FIG. 6, which includes additionally a surface-grinding step H and a second chamfering step B2 after the etching step D.

The case in which a conventional surface-grinding technique is applied to the processing method of FIG. 8 is shown in FIG. 11(*a*) to FIG. 11(*g*).

In FIG. 11(*a*) to FIG. 11(*g*), the same marks as those in FIG. 10(*a*) to FIG. 10(*i*) are denoted the same members as those in FIG. 10(*a*) to FIG. 10(*i*).

The method shown in these FIG. 8 and FIG. 11(*a*) to FIG. 11(*g*) had an advantage that waviness was eliminated from a wafer, but had disadvantages that the number of the steps increased and thereby manufacturing cost was raised.

Therefore, the current surface-processing step is usually conducted by a lapping treatment and a surface-grinding technique using a surface-grinding machine and has difficulty in being introduced into an actual wafer manufacturing process, despite of the advantage of being able to process a wafer or wafers each with less dispersion of thickness.

On the other hand, by means of the lapping step used in the processing methods of FIGS. 6 and 8, waviness is improved as shown in FIG. 9(*a*) to FIG. 9(*d*) and FIG. 11(*a*) to FIG. 11(*g*), but improvement of bow is not expected very much and thus no effective elimination method of bow was available in the past.

SUMMARY OF THE INVENTION

The present invention was made in view of the above-mentioned problem.

It is an object of the present invention to provide a method and apparatus for surface-grinding of a workpiece or workpieces which makes it possible to correct and improve waviness and bow, to obtain a workpiece or workpieces without thickness dispersion, further to conduct processing of a workpiece or workpieces to higher precision than in the past, still further to simplify the processing method and to realize reduction of the processing cost.

The present invention is a surface-grinding method for a workpiece or workpieces, which is devised to solve the above-mentioned problem, wherein a first surface of the workpiece or each of the workpieces is fixedly supported by the fixedly supporting means of a surface grinding apparatus and a second surface of the workpiece or workpieces is surfaced ground, characterized in that the workpiece or workpieces are fixed by the aid of adhesive material on a base plate and the plate is fixedly supported by its own lower surface on the fixedly supporting means.

The surface-grinding method of the present invention will be described further in a more concrete manner.

It comprises:

(a) a step, in which a workpiece or workpieces are fixed at one surface thereof to the upper surface of a base plate by the aid of adhesive material;

(b) a step, in which the base plate is fixed for supporting by the lower surface of itself on a fixedly supporting means;

(c) a step, in which the other surface of each of the workpieces fixedly supported is surface-ground;

(d) a step, in which the base plate and the workpiece or workpieces, the other surface of each of which has been surface-ground, are released from the fixedly supporting means;

(e) a step, in which the workpiece or workpieces, the other surface of each of which has been surface-ground, are separated from the base plate;

(f) a step, in which the workpiece or workpieces, the other surface of each of which has been surface-ground, is turned upside down;

(g) a step, in which the workpiece or workpieces are fixedly by the other surface of each, which has been surface-ground, on the fixedly supporting means;

(h) a step, in which the one surface of each workpiece, by which it was first fixedly supported, is surface-ground; and (i) a step, in which the workpiece or workpieces, both surfaces of each of which have been surface-ground, are released from the fixedly supporting means.

Wax, adhesive, gypsum, ice or the like can be used as the above-mentioned adhesive material.

In the state of a wafer after separation from a base plate, these adhesive materials are attached to the lower surface of the workpiece.

When they are a hindrance to surface-grinding work, it will be enough if they are removed by respective removing agents. In case of ice, all that is required is to melt the ice off by heating. In another case of an attachment like gypsum, the workpiece can be surface-ground while it is attached on the lower surface.

It is preferred to use a vacuum-chuck means as the above-mentioned fixedly supporting means for a workpiece or workpieces but a mechanical chuck means or an electromagnetic chuck means can also be used.

On the other hand, the present inventive apparatus is a surface-grinding apparatus comprising a surface-grinding means and a fixedly supporting means. In the apparatus a workpiece or workpieces are fixed at one surface thereof to the upper surface of a base plate by the aid of adhesive material, the adhering composite of the workpiece or workpieces and the base plate is fixed by the lower surface of the plate on the fixedly supporting means and in this state the other surface of each of the workpieces is surface-ground.

In addition, surface processing of a workpiece or workpieces can be effectively conducted by application of the surface-grinding method of the present invention as the surface-grinding step in a surface processing method of a workpiece or workpieces comprising:

a slicing step, in which a raw material ingot or raw material ingots are cut into workpieces;

a surface-grinding step, in which each sliced workpiece is surface-ground;

a chamfering step, in which each surface-ground workpiece is chamfered;

a polishing step, in which each chamfered workpiece is polished.

The surface-grinding method of the present invention is well applied especially in case of the use of a wire saw, which is subject to occurrence of waviness in a slicing step. It is also applicable to the cases where any cutting means, such as a circular inner peripheral blade or a band saw, is used.

When there is the bow due to work damage in a workpiece just after a slicing step, it is preferred to conduct etching on the surface of the workpiece prior to the surface-grinding step.

A supplying means for molten adhesive material, for example, molten wax, hot-melt adhesive or the like into each gap between a base plate and a workpiece or workpieces may comprise:

a storage tank, in the interior of which molten adhesive material is stored;

a pressure means, by which a internal pressure is given to the storage tank;

a pipe means, through which the molten adhesive material is transported under pressure from the storage tank;

a pair of an upper heating means and a lower heating means, both of which face each other.

The operation is conducted as follows: The base plate is placed on the lower heating means, the workpiece or workpieces are placed on the base plate, then the workpiece or workpieces and plate all are heated by both of the heating means.

And the molten adhesive material is supplied into each gap between the base plate and each workpiece being heated, by way of the pipe means, under an internal pressure in the storage tank by the pressure means.

According to the supplying means and operation above, the base plate and each workpiece can adhere to one another without a bubble between each gap.

As a workpiece used in the present invention, a semiconductor wafer and the like are used up as examples.

The present invention realizes a fixing technique that a workpiece or workpieces, for example wafers, having waviness and bow are fixed on the working table of a surface-grinding apparatus, such as a surface-grinding machine, while the waviness and bow are kept as originally occurred, that is, uncorrected.

The fixing technique, thus, makes it possible to attain a wafer or wafers of good flatness by surface-grinding.

In concrete terms, a wafer or wafers are fixed on a thick and rigid base plate by the aid of adhesive material, such as wax, and the base plate is then chucked to a surface-grinding machine by means of a vacuum chuck means.

Since the adhesive material fills each gap between the base plate and each wafer, the wafer or wafers are supported without any deformation and can be surface-ground to the surface of good flatness.

In the next stage, if the wafer or wafers are chucked by the surface of good flatness of each on a vacuum chuck means and the other surface of each is surface-ground, the wafer or wafers without waviness, bow and thickness dispersion can be manufactured.

BRIEF DESCRIPTION OF THE DRAWINGS

Further objects and advantages of the present invention will be apparent from the following description, reference being made to the accompanying drawings wherein preferred embodiments of the present invention are clearly shown.

In the drawings.

DETAILED DESCRIPTION OF THE PREFERRED EMBODIMENTS

Below, an embodiment of the present invention will be explained on the basis of FIG. 1(*a*) to FIG. 1(*i*), through FIG. 5.

Figure 5:
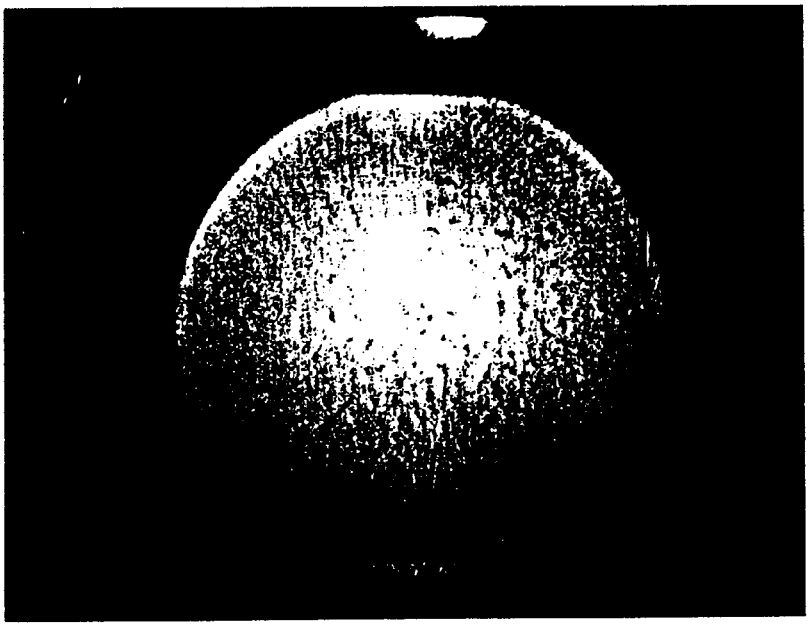
FIG. 5 is a photograph showing the surface of a wafer processed by surface-grinding according to the present invention.
Figure 6:
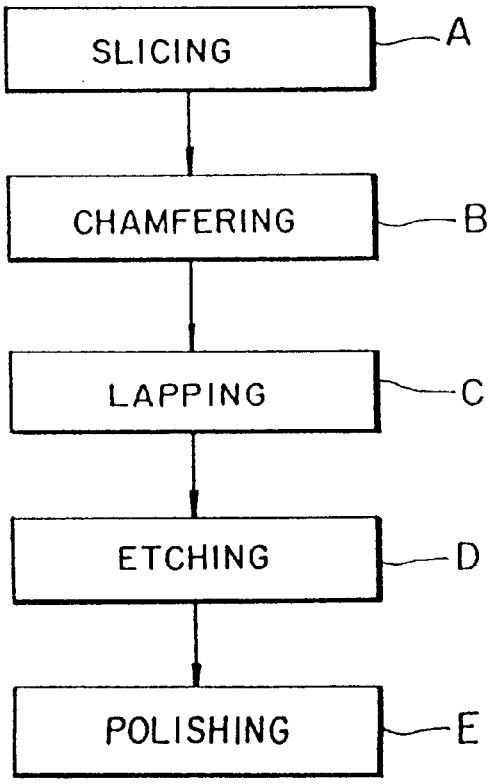
FIG. 6 PRIOR ART
FIG. 6 is a flow chart illustrating a conventional wafer processing method.

In FIG. 1(*a*) to FIG. 1(*i*), through FIG. 5, the same marks as those used in FIG. 6 through FIG. 12 are respectively used at the same members as or similar ones to those of FIG. 6 through FIG. 12.

In the following embodiment, the description is made about the case where a wafer is taken as a preferred example of the workpiece.

In FIG. 1(*a*) to FIG. 1(*i*), SW is a raw material wafer, which has been sliced by the use of a wire saw, not shown.

Surface irregularity drawn on both of the upper surface and lower one of the wafer SW (FIG. 1(*a*)) is a stressed view of waviness.

The generally curved form of the wafer SW is also a stressed view of bow.

Figure 4:
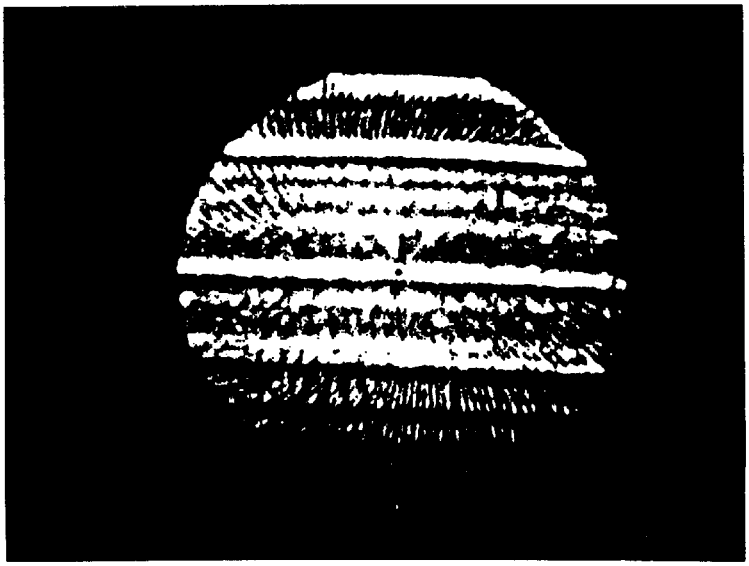
FIG. 4 is a photograph showing the surface of a wafer sliced by a wire saw.

A photograph of the raw material wafer SW, which has been sliced, is shown in FIG. 4.

The raw material wafer SW is fixed by the lower surface on the upper surface of a flat base plate 14 by the aid of adhesive material, such as wax, (Step (a), FIG. 1(*b*)), where the base plate 14 has to be a thick, rigid and flat plate.

As for adhesive materials other than wax suitably used in the method of the present invention are gypsum, ice and others as far as they work on a workpiece in the same way as wax does.

Then, the base plate 14, on which the wafer SW has been fixed, is fixed for supporting (by chucking) on a vacuum chuck means 12 by its own lower surface (Step (b), FIG. 1(*b*)).

Figure 1A:
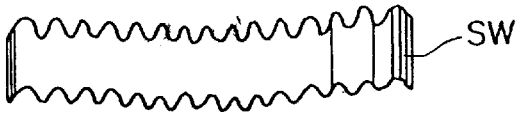
FIG. 1(*a*) to FIG. 1(*i*) are illustrative views showing an example of a process in a surface-grinding method according to the present invention.
Figure 1B:
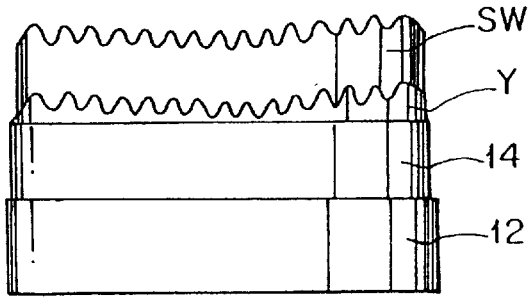
Figure 1C:
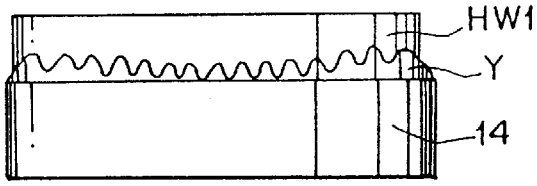
Figure 1D:
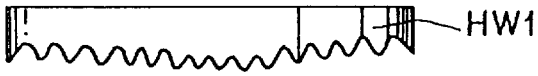
Figure 1E:
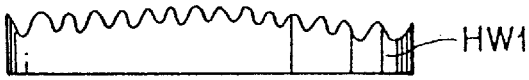
Figure 1F:
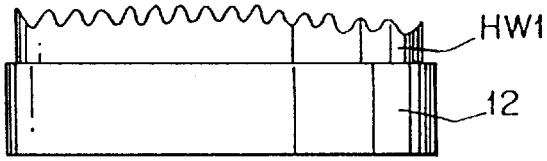
Figure 1G:
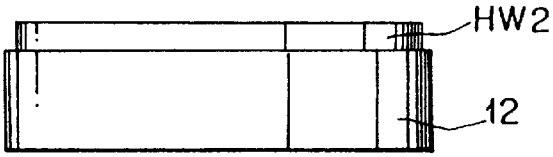
Figure 1H:
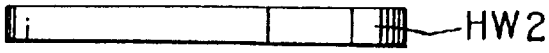
Figure 1I:
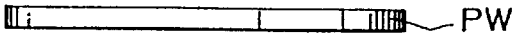
Figure 2:
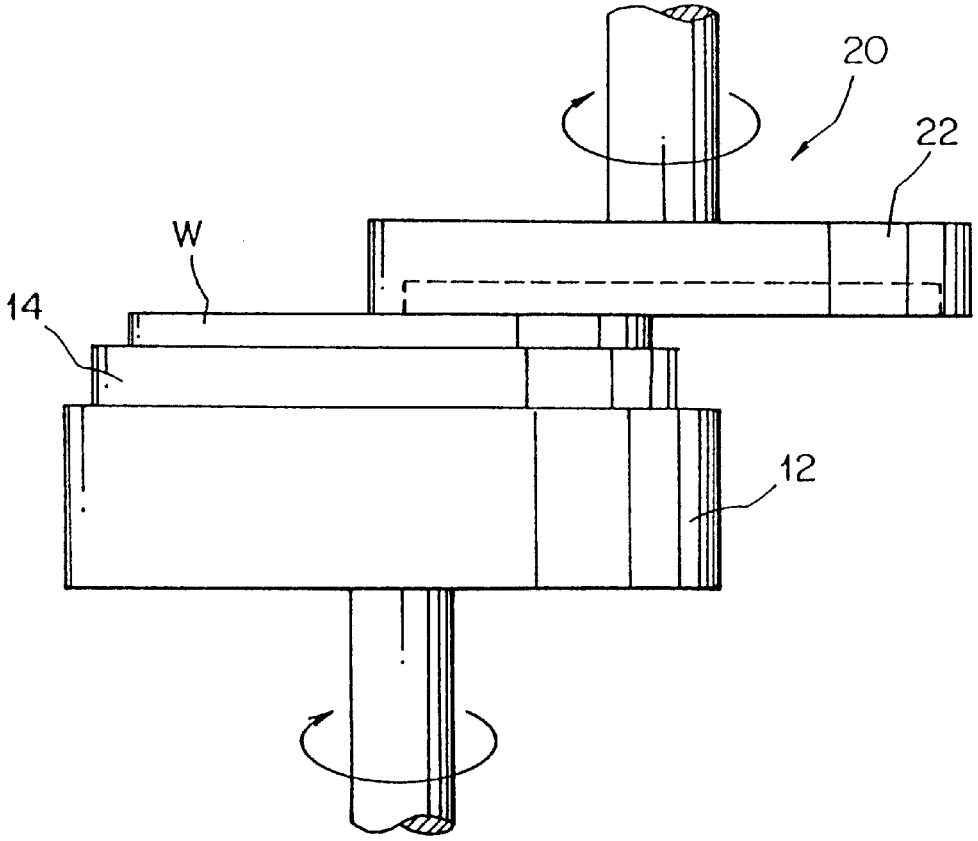
FIG. 2 is a schematically illustrative view showing an example of a surface-grinding apparatus according the present invention.

As this vacuum chuck means 12, for example, the vacuum chuck means 12 of the surface-grinding machine 20 as shown in FIG. 2, similar to a conventional apparatus, is well used as it is.

As a fixedly supporting means for the base plate 14, the vacuum chuck means 12 is exemplified here, but it is natural that other publicly known fixedly supporting means are also applicable.

The upper surface of the wafer SW, which has been fixed on the upper surface of the base plate 14 chucked by the vacuum chuck means 12, is surface-ground (Step (c), FIG. 1(*c*)).

It will be enough if this surface-grinding is conducted by means of, for example, the surface-grinding means of the surface-grinding machine 20, that is, the grinding stone 22.

A wafer HW1, the upper surface of which has been surface-ground, is released from the vacuum chuck means 12 together with the base plate 14 (Step (d), FIG. 1(*c*)).

The wafer HW1, the upper surface of which has been surface-ground, is separated from the base plate 14 (Step (e), FIG. 1(*d*)).

At this time, since, on the lower surface of the wafer HW1, the adhesive material Y remains attached, this adhesive material Y is removed by a removing agent.

If ice is used, it is melted off by heating. In the case of adhesive material Y (for example gypsum), which is no hindrance against surface-grinding of the lower surface of the wafer HW1, a special removal treatment is not required, since the adhesive material Y can be removed concurrently with the surface-grinding.

The wafer HW1, the upper surface of which has been surface-ground, is turned upside down (Step (f), FIG. 1(*e*)).

The wafer HW1, the upper surface of which has been surface-ground, is chucked by its own upper surface on the vacuum-chuck means 12 (Step (g), FIG. 1(*f*)).

The lower surface of the wafer HW1, which has been fixed by chucking, is surface-ground (Step (h), FIG. 1(*g*)).

The wafer HW2, both surfaces of which have been surface-ground, is released from the vacuum-chuck means 12 (Step (i), FIG. 1(*h*)).

Figure 10:
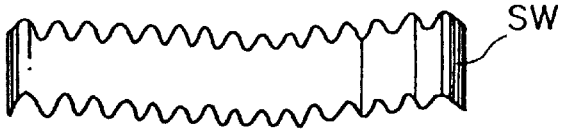
FIG. 10 (a) PRIOR ART
FIG. 10(*a*) to FIG. 10(*i*) are illustrative views showing changes of the cross-sections of wafers which are processed in the process illustrated in FIG. 7, with some concrete views.
Figure 10:
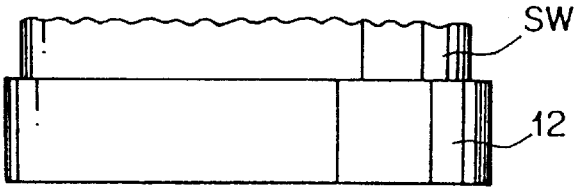
FIG. 10 (b) PRIOR ART
Figure 10:
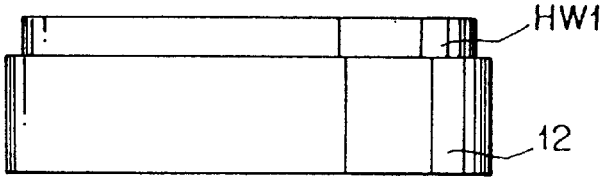
FIG. 10 (c) PRIOR ART
Figure 10:
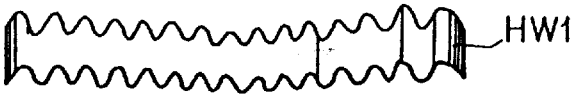
FIG. 10 (d) PRIOR ART
Figure 10:
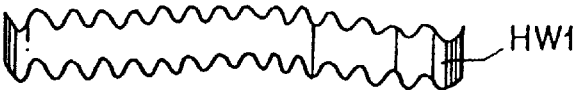
FIG. 10 (e) PRIOR ART
Figure 10:
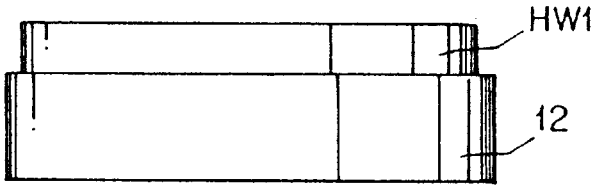
FIG. 10 (f) PRIOR ART
Figure 10:
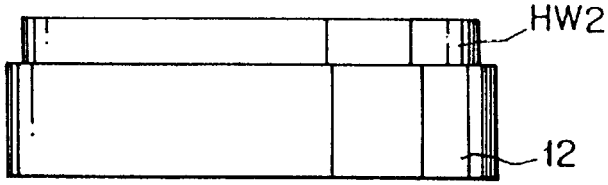
FIG. 10 (g) PRIOR ART
Figure 10:
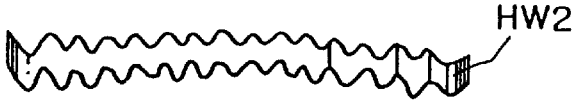
FIG. 10 (h) PRIOR ART
Figure 10:
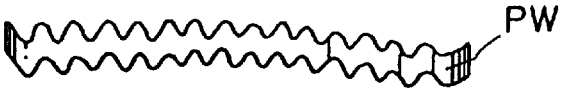
FIG. 10 (i) PRIOR ART
Figure 11:
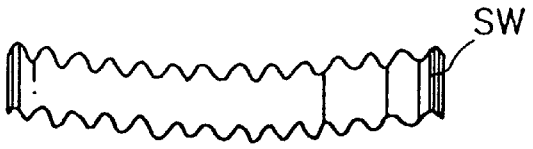
FIG. 11 (a) PRIOR ART
FIG. 11(*a*) to FIG. 11(*g*) are illustrative views showing changes of the cross-sections of wafers which are processed in the process illustrated in FIG. 8, with some concrete views.
Figure 11:
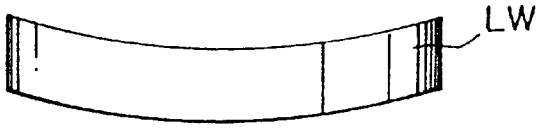
FIG. 11 (b) PRIOR ART
Figure 11:
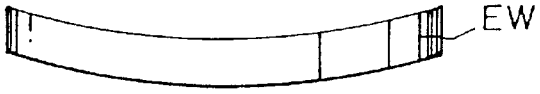
FIG. 11 (c) PRIOR ART
Figure 11:
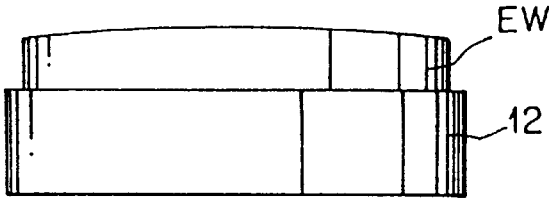
FIG. 11 (d) PRIOR ART
Figure 11:
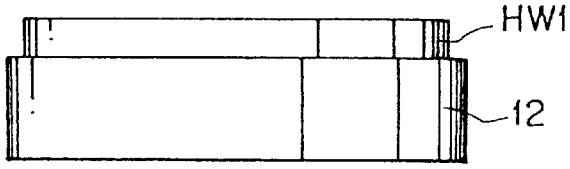
FIG. 11 (e) PRIOR ART
Figure 11:
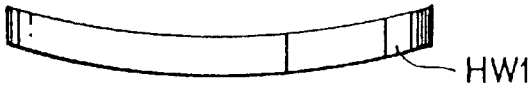
FIG. 11 (f) PRIOR ART
Figure 11:
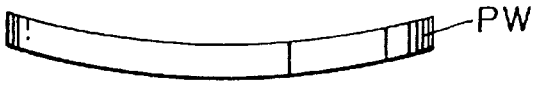
FIG. 11 (g) PRIOR ART
Figure 12:
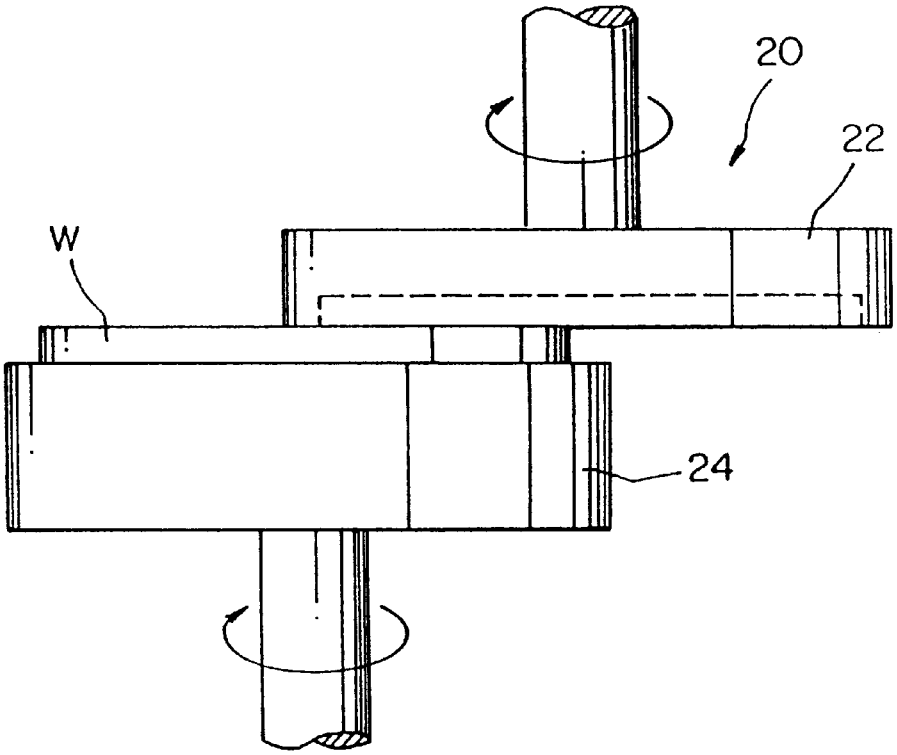
FIG. 12 PRIOR ART
FIG. 12 is a schematically illustrative view showing a publicly known surface-grinding apparatus.

This wafer HW2, both surfaces of which have been surface-ground, is different from that processed by the conventional surface-grinding as shown in FIG. 10(*h*) and it is so well shaped that the waviness on the both surfaces is completely corrected, the thickness dispersion disappears and the bow is also corrected.

The surface photograph of the thus surface-ground wafer HW2 is shown in FIG. 5. As can be seen from the photograph, it is confirmed that the waviness and bow are completely removed.

The surface-ground wafer HW2 will be further processed by bevelling and polishing (FIG. 1(*i*)).

With the adoption of a surface-grinding method according to the present invention, a wafer or wafers which are free from waviness and bow, and free from thickness dispersion, can be obtained by surface-grinding.

For that reason, in a conventional wafer process, even an etching step, in some cases, as well as a lapping step, can be omitted.

In adhesion of a base plate 14 and a wafer or wafers W, it is important in order to tighten the adhesion that a bubble is not included in the adhesive material.

Figure 3:
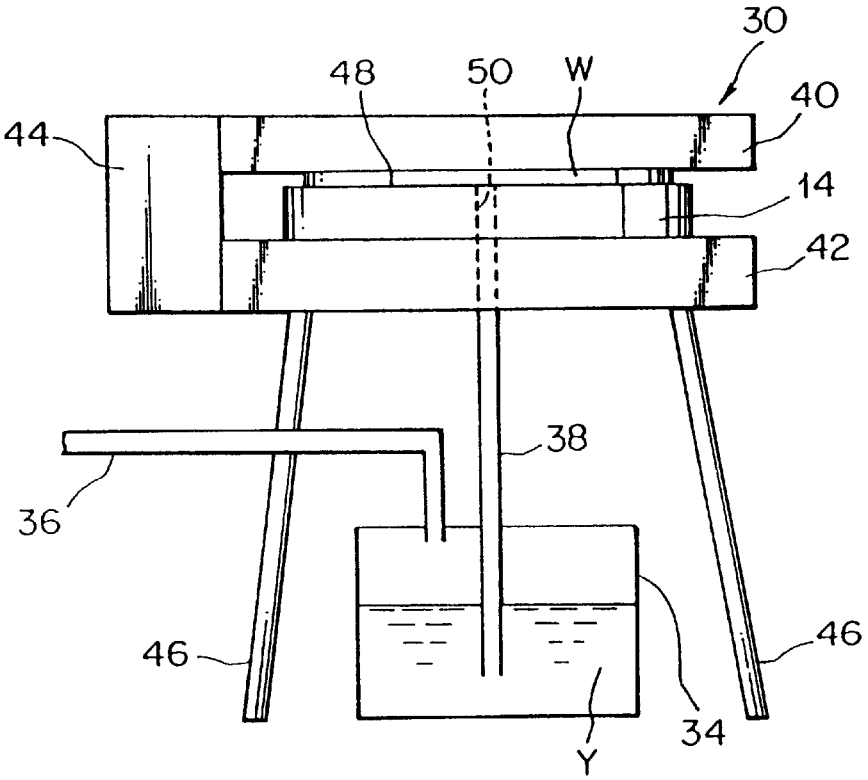
FIG. 3 is a schematically illustrative view showing an example of a supply apparatus for molten adhesive material according to the present invention.

An example of the apparatus, which can supply adhesive material, for example molten wax, hot-melt adhesive or the like, without accompanying a bubble, is explained in reference to FIG. 3.

In FIG. 3, Mark 30 is a supply apparatus for molten adhesive material. The apparatus 30 comprises:

- a storage tank 34, in the interior of which molten adhesive material, for example molten wax, hot-melt adhesive and the like, is stored;
- a pressure means, for example a pressure line 36, which gives an internal pressure to the storage tank 34;
- a pipe means 38, through which the molten adhesive material Y is transported under pressure from the storage tank 34;
- a pair of an upper heating means, for example an upper hot plate 40, and a lower heating means, for example a lower hot plate 42, which face each other.

The upper heating means 40 is installed pivotably and in such a manner that it opens or closes freely by the help of a support member 44.

The wafer W and the base plate 14 are placed on the lower heating means 42.

When they are removed, the upper heating means 40 is opened. When the molten adhesive material Y is supplied, it is closed like the view.

Marks 46 and 46 are support legs for supporting the lower heating means 42.

Supply of adhesive material Y is conducted with this apparatus 30 in the following way:

- First, the upper heating means 40 is opened, then the base plate 14 is placed on the lower heating plate 42 and after that a wafer W is placed on the base plate 14.
- Then, the upper heating means 40 is closed. And the base plate 14 and the wafer W are respectively heated by the lower heating means 42 and the upper heating means 40.
- In this state, adhesive material Y is supplied into the gap 48 between the base plate 14 and the wafer W, through the pipe means 38 under an internal pressure applied to the storage tank 34 by the pressure means 36.
- There is no special limitation to the embodiments of the pipe means 38, since it is only required to supply the adhesive material Y to the gap 48.

In the example shown in the figure, a case is illustrated, where the pipe means 38 is penetrated through the interiors of both the lower heating means 42 and base plate 14. In this case, a through-hole 50 for a pipe has been bored in the base plate 14.

After the completion of supply operation of the adhesive material Y, the upper heating means 40 is opened and an adhering composite of the base plate 14 and the wafer W is taken out as a piece.

By the use of this supply apparatus 30 of molten adhesive material, the molten adhesive material Y can be supplied into the gap 48 without introduction of a bubble to tightly combine both of them.

Figure 7:
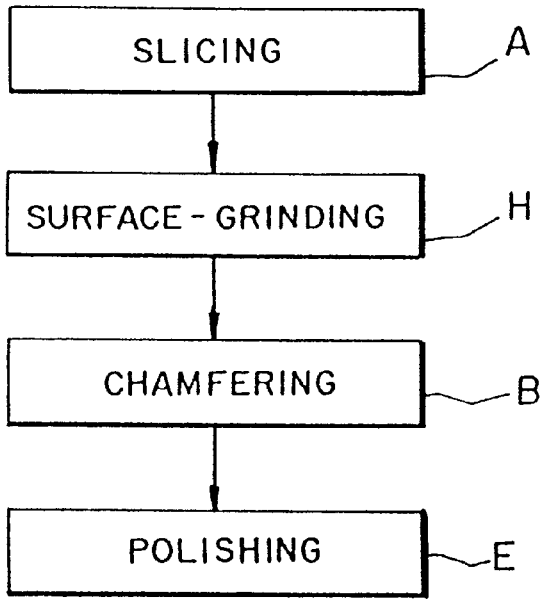
FIG. 7 PRIOR ART
FIG. 7 is a flow chart illustrating an example of the wafer processing method in a case in which a surface-grinding step is introduced.
Figure 8:
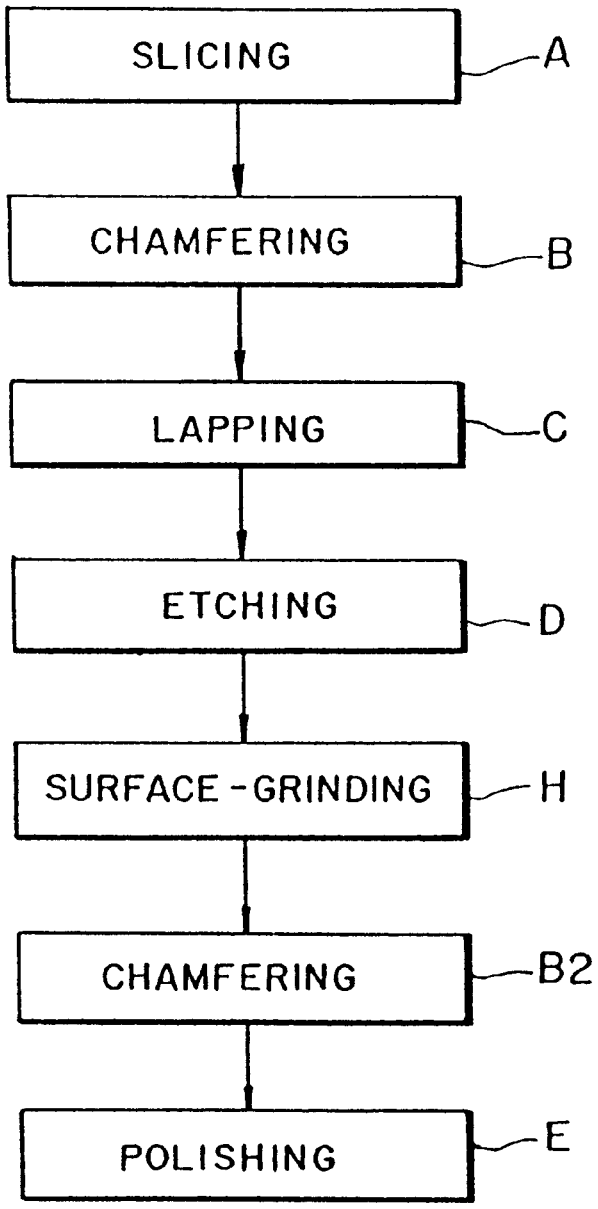
FIG. 8 PRIOR ART
FIG. 8 is a flow chart illustrating another example of the wafer processing method in a case in which a surface-grinding step is introduced.
Figure 9:
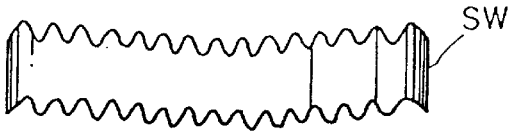
FIG. 9 (a) PRIOR ART
FIG. 9(*a*) to FIG. 9(*d*) are illustrative views showing changes, in sequence of steps, of the cross-sections of wafers which are processed in the process illustrated in FIG. 6.
Figure 9:
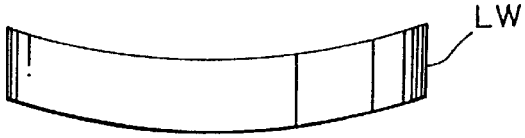
FIG. 9 (b) PRIOR ART
Figure 9:
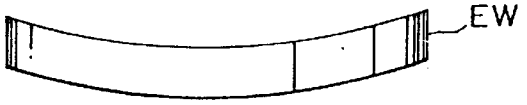
FIG. 9 (c) PRIOR ART
Figure 9:
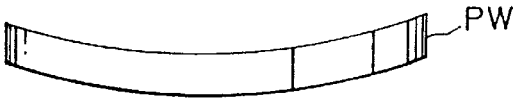
FIG. 9 (d) PRIOR ART

In the above-mentioned embodiment, the example, in which the surface-grinding method of the present invention is applied to the surface-grinding step in a conventional processing method as is shown in FIG. 7, is explained.

The feature of the present inventive method lies, however, in that a workpiece or workpieces, such as wafers, are fixed by one surface thereof to the upper surface of a base plate by the aid of adhesive material and the other surface of each workpiece is surface-ground, while the base plate is fixedly supported by its own lower surface.

It is needless to state that any modification of the workpiece processing method, which includes this inventive feature, still falls within the technological scope of the present invention.

As described above, according to the present invention, even with a workpiece or workpieces, such as wafers, having waviness and bow, the waviness and bow can be corrected and surface-grinding technique can be applied to obtain a good workpiece having no thickness dispersion.

By these facts, the surface-grinding step can be incorporated in place of the conventional lapping step, so that workpiece processing, of higher precision than that in the past, is realized and the workpiece process can be simplified to have an advantage of realization of cost reduction.

What is claimed is:

1. A surface-grinding method for a wafer having waviness or bow which comprises:

fixedly supporting at least one wafer by a first surface thereof to a first surface of a base plate by means of an adhesive provided therebetween, while maintaining the waviness or bow of the least one wafer;

fixedly supporting the base plate by a second surface thereof to a fixedly supporting means of a surface-grinding apparatus; and surface-grinding a second surface of the at least one wafer.

2. A surface-grinding method for a workpiece as claimed in claim 1, wherein the adhesive material is wax, gypsum or ice.

3. A surface-grinding method for a workpiece as claimed in claim 1, wherein the fixedly supporting means is a vacuum-chuck means.

4. A method claimed in claim 1, wherein the at least one wafer comprises a semiconductor wafer.

5. A method claimed in claim 4, wherein the fixedly supporting means comprises a vacuum chuck.

6. A method as claimed in claim 1, wherein the fixedly supporting the wafer to the base plate by means of an adhesive is performed at a temperature and a pressure which would avoid deformation of the wafer.

7. A method as claimed in claim 1, wherein the fixedly supporting the wafer to the base plate by means of an adhesive includes injecting the adhesive under pressure between the surface of the wafer and the surface of the base plate.

8. A method as claimed in claim 1, wherein the wafer and base plate are preheated prior to the introduction of the adhesive.

9. A method as claimed in claim 1, wherein the wafer and base plate are at atmospheric pressure during fixedly supporting the wafer to the base plate by means of an adhesive.

10. A method as claimed in claim 1, wherein the adhesive is preheated and injected under pressure.

11. A method claimed in claim 1 including:

slicing raw material ingot or raw material ingots into wafers prior to fixedly supporting the wafer;

chamfering the surface-ground wafer; and polishing the chamfered wafer.

12. A method claimed in claim 11 wherein a wire saw is used in the slicing step.

13. A method claimed in claim 11 including an etching step between the slicing step and the surface-grinding method.

14. A surface-grinding method for a wafer having waviness or bow which comprises the following steps:

(a) fixedly supporting at least one wafer by a first surface thereof to a first surface of a base plate by mans of an adhesive provided therebetween, while maintaining the waviness or bow of the at least one wafer;

(b) fixedly supporting the base plate by a second surface thereof to a fixedly supporting means of a surface-grinding apparatus;

(c) surface-grinding a second surface of the at least one wafer;

(d) releasing the at least one wafer and the base plate from the fixedly supporting means;

(e) separating the at least one wafer from the base plate;

(f) fixedly supporting the at least one wafer by the second surface thereof to the fixedly supporting means of the surface-grinding apparatus;

(g) surface-grinding the first surface of the at least one wafer; and (h) releasing the at least one wafer from the fixedly supporting means.

15. A surface-grinding method for a workpiece as claimed in claim 14, wherein the adhesive material is wax, gypsum or ice.

16. A surface-grinding method for a workpiece as claimed in claim 14, wherein the fixedly supporting means is a vacuum-chuck means.

17. A method claimed in claim 14, wherein the at least one wafer comprises a semiconductor wafer.

18. A method claimed in claim 17, wherein the fixedly supporting means comprises a vacuum chuck.

19. A method as claimed in claim 14, wherein the fixedly supporting the wafer to the base plate by means of an adhesive is performed at a temperature and a pressure which would avoid deformation of the wafer.

20. A method as claimed in claim 14, wherein the fixedly supporting the wafer to the base plate by means of an adhesive includes injecting the adhesive under pressure between the surface of the wafer and the surface of the base plate.

21. A method as claimed in claim 14, wherein the wafer and base plate are preheated prior to the introduction of the adhesive.

22. A processing method as claimed in claim 14 for a workpiece or workpieces comprising:

slicing a raw material ingot or raw material ingots into wafers prior to fixedly supporting the wafer;

chamfering the surface-ground wafer; and polishing the chamfered wafer.

23. A method claimed in claim 22 wherein a wire saw is used in the slicing step.

24. A method claimed in claim 22 including an etching step between the slicing step and the surface-grinding step.

* * * * *